US007794628B2

(12) United States Patent
Takashima et al.

(10) Patent No.: US 7,794,628 B2
(45) Date of Patent: Sep. 14, 2010

(54) CHIP-SHAPED ELECTRONIC COMPONENT

(75) Inventors: Naohiro Takashima, Fukui (JP); Shoji Hoshitoku, Fukui (JP); Takasi Oobayasi, Osaka (JP); Mituru Harada, Osaka (JP)

(73) Assignee: Panasonic Corporation, Osaka (JP)

( * ) Notice: Subject to any disclaimer, the term of this patent is extended or adjusted under 35 U.S.C. 154(b) by 238 days.

(21) Appl. No.: 12/067,126

(22) PCT Filed: Aug. 28, 2006

(86) PCT No.: PCT/JP2006/316888

§ 371 (c)(1),
(2), (4) Date: Mar. 17, 2008

(87) PCT Pub. No.: WO2007/032201

PCT Pub. Date: Mar. 22, 2007

(65) Prior Publication Data

US 2009/0134361 A1 May 28, 2009

(30) Foreign Application Priority Data

Sep. 15, 2005 (JP) ..... 2005-267856

(51) Int. Cl.
*H01B 1/06* (2006.01)

(52) U.S. Cl. ..... 252/511; 252/500; 252/503; 252/504; 252/507; 252/508; 252/509; 338/309; 361/303

(58) Field of Classification Search ..... 252/500, 252/503, 504, 507, 508, 509, 511; 338/309; 361/303
See application file for complete search history.

(56) References Cited

FOREIGN PATENT DOCUMENTS

| | | |
|---|---|---|
| JP | 07-282621 | * 10/1995 |
| JP | 7-283004 | 10/1995 |
| JP | 2002-222702 | * 8/2002 |
| JP | 2004-111459 | * 4/2004 |
| JP | 2004-288956 | * 10/2004 |
| JP | 2004-288957 | 10/2004 |
| JP | 2005-108956 | * 4/2005 |

OTHER PUBLICATIONS

International Search Report issued Nov. 28, 2006 in the International (PCT) Application No. PCT/JP2006/316888.

* cited by examiner

*Primary Examiner*—Mark Kopec
*Assistant Examiner*—Khanh Tuan Nguyen
(74) *Attorney, Agent, or Firm*—Wenderoth, Lind & Ponack, L.L.P.

(57) ABSTRACT

A chip-shaped electronic component includes a substrate and an end face electrode layer provided on an end face of the substrate, in which the end face electrode layer contains a mixed material. The mixed material includes as a conductive particle, a carbon powder, a whisker-like inorganic filler coated with a conductive film, and a flake-like conductive powder. Additionally, an epoxy resin has a weight-average molecular weight between 1,000 and 80,000.

24 Claims, 4 Drawing Sheets

CHIP-SHAPED ELECTRONIC COMPONENT

BACKGROUND OF THE INVENTION

1. Technical Field

The present invention relates to a chip-shaped electronic component to be used in various electronics. More specifically, it relates to a minute chip-shaped electronic component.

2. Background Art

In an increasing demand for lighter, thinner, smaller electronic equipment, an extremely small sized chip-shaped electronic component has come to be widely used for electronic equipment in order to increase the wiring density of the circuit substrate. Recently, a very small sized chip-shaped electronic component having a length of 1.0 mm, a width of 0.5 mm, and a thickness of 0.25 mm is coming in a main stream.

A conventional chip-shaped electronic component will be described exemplifying a rectangular chip resistor.

FIG. 3 is a perspective view illustrating a configuration of the conventional rectangular chip resistor; and FIG. 4 is a cross sectional view of the rectangular chip resistor of FIG. 3.

In FIGS. 3 and 4, 1 denotes a substrate made of a 96 alumina substrate; and 2 denotes a pair of upper surface electrode layers formed on both ends of an upper surface of the substrate 1. The pair of upper surface electrode layers 2 is made of a thick silver-based film electrode. 3 denotes a resistor layer formed so as to be electrically connected to the pair of the upper surface electrode layers 2. The resistor layer 3 is made of a thick ruthenium-based film resistor. 4 denotes a protection layer formed so as to cover the resistor layer 3 in its entirety. The protection layer 4 comprises an epoxy based resin. 5 denotes a pair of end face electrode layers provided on both end faces of the substrate 1 so that they are electrically connected to the pair of upper surface electrode layers 2. The pair of end face electrode layers 5 comprises a mixed material containing conductive particles and a resin. 6 denotes nickel-plated layers provided so as to cover exposed portions of the end face electrode layers 5 and the upper surface electrode layers 2, and 7 denotes solder- or tin-plated layers provided so as to cover the nickel-plated layers 6. A combination of the nickel plated layer 6 and the solder- or tin-plated layer 7 forms an external electrode.

For example, Japanese Unexamined Patent Publication (Kokai) No. 07-283004 is known as a related art in a field of the invention in the present application.

In the case where a chip-shaped electronic component represented by the above-described rectangular chip resistor is mounted on a glass epoxy board or the like, the chip-shaped electronic component is subjected to a temperature environment of about 250° C. for several seconds in order to melt a solder. In this case, in the above-described chip-shaped electronic component represented by the rectangular chip resistor, such drawbacks occurred that the nickel-plated layers 6 and the solder- or tin-plated layers 7 formed on the end face electrode layers 5 comprising the mixed material containing the conductive particles and the resin are perforated or the solder splashes. In accordance with the recent high density mounting of electronic components, since mounting intervals between the chip-shaped electronic components become narrower, poor conduction and the like due to the above-described drawbacks come to frequently occur.

The inventors in the present application have studied in order to resolve the above drawbacks. As a result of the studies, it was found that the drawbacks of occurrence of perforation in the nickel-plated layers 6 and the solder- or tin-plated layers 7, and the solder splash are adversely affected by a gas generated from the end face electrode layers 5. It is considered that the gas is generated because of remaining moisture, cracked gas and so on. However, it is difficult to specify the cause of the drawbacks and it is considered that a plurality of factors is mixed to cause the drawbacks.

SUMMARY OF THE INVENTION

An object of the present invention which was made in order to resolve the above-described drawbacks is to reduce such drawbacks as perforation in the nickel-plated layers and the solder- or tin-plated layers and solder splash when the solder is heated to melt, and to provide a chip-shaped electronic component excellent in mass production.

An aspect of the present invention is directed to a chip-shaped electronic component including: a substrate; and end face electrode layers provided at end faces of the substrate; in which the end face electrode layers contain a mixed material including, as a conductive particle, a carbon powder; a whisker-like inorganic filler coated with a conductive film; and a flake-like conductive powder; and an epoxy resin having a weight-average molecular weight (hereinafter simply referred to as "molecular weight") of 1,000 to 80,000.

Objects, features, aspects and advantages of the present invention become more apparent from the following detailed description and accompanying drawings.

DETAILED DESCRIPTION OF THE INVENTION

First Embodiment

A rectangular chip resistor according to a first embodiment of the invention will now be described below with reference to the accompanying drawings.

Figure 1:
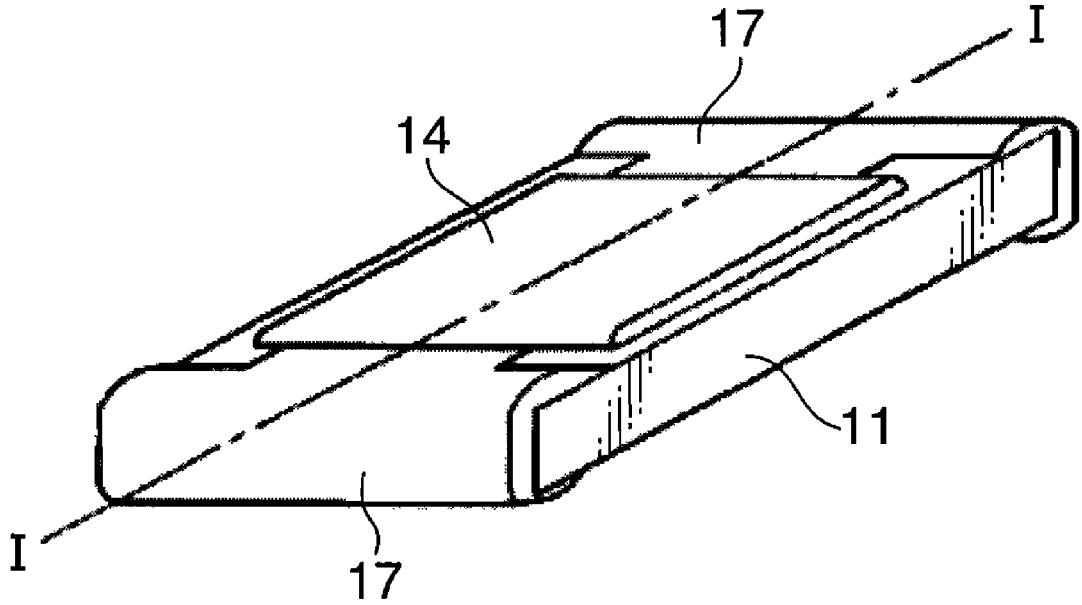
FIG. 1 is a perspective view of a rectangular chip resistor according to a first embodiment of the invention.
Figure 2:
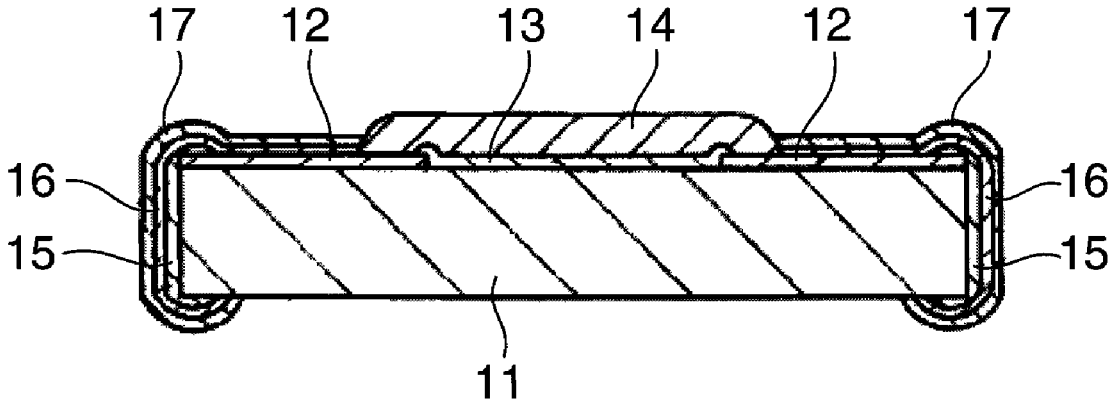
FIG. 2 is a cross sectional view of the rectangular chip resistor of FIG. 1 taken along lines I-I.
Figure 3:
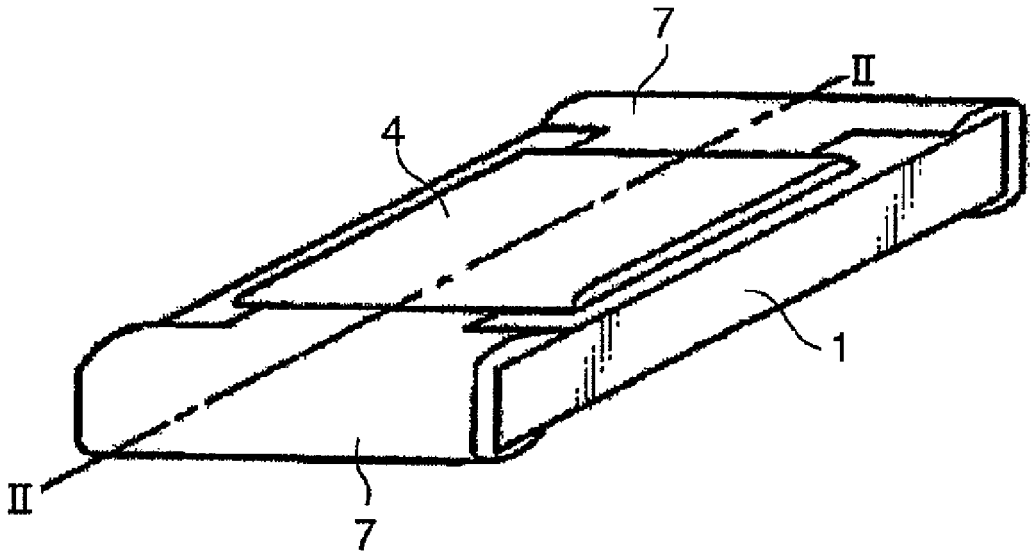
FIG. 3 is a perspective view of a conventional chip resistor.
Figure 4:
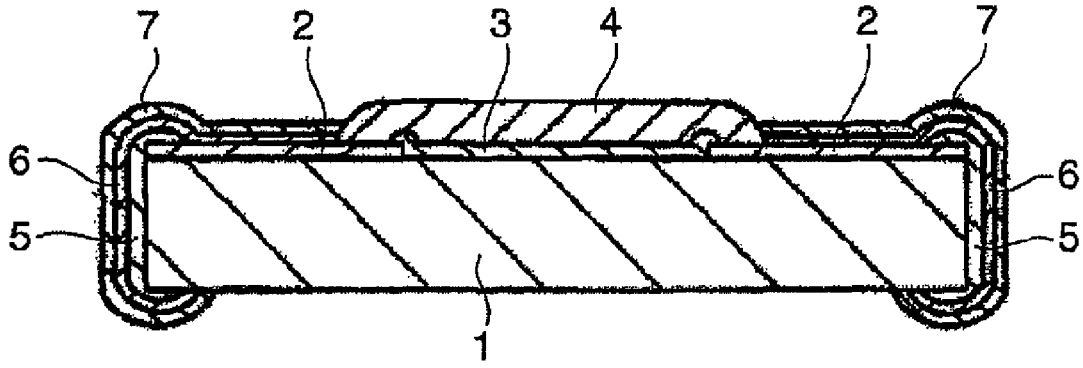
FIG. 4 is a cross-sectional view of the conventional chip-shaped resistor of FIG. 3 taken along lines II-II.

FIG. 1 is a perspective view of the rectangular chip resistor according to the first embodiment of the invention; and FIG. 2 is a cross sectional view of the rectangular chip resistor of FIG. 1.

In FIGS. 1 and 2, 11 denotes a substrate comprising a 96 alumina substrate; and 12 denotes a pair of upper surface electrode layers formed on both ends of the upper surface of the substrate 11. The pair of upper surface electrode layers 12 is made of a thick silver-based film electrode. 13 denotes a resistor layer formed so as to be electrically connected to the pair of upper surface electrode layers 12. The resistor layer 13 comprises a thick ruthenium-based film resistor. 14 denotes a protection layer formed so as to completely cover the resistor layer 13. The protection layer 14 is made of an epoxy based resin. 15 denotes a pair of end face electrode layers provided at both end faces of the substrate 11 so that they are electrically connected to the pair of upper surface electrode layers 12. The pair of end face electrode layers 15 comprises a mixed material including a conductive particle and a resin. 16 denotes nickel-plated layers provided so that they cover exposed portions of the end face electrode layers 15 and the upper surface electrode layers 12. 17 denotes solder- or tin-plated layers provided so as to cover the nickel-plated layers 16. A combination of the nickel plated layer 16 and the solder- or tin-plated layer 17 forms an external electrode.

A process for producing the rectangular chip resistor having the above-described configuration will now be described.

Initially, a sheet-shaped substrate comprising a 96 alumina substrate having excellent heat resistance and insulation properties is prepared. The sheet-shaped substrate is preliminary provided with grooves for dividing the substrate into reed-shaped pieces and individual pieces (the grooves are formed when a green sheet is subjected to molding).

Next, a thick-film silver paste is screen printed on an upper surface of the sheet-shaped substrate to thereafter dry the paste. Then, the thick-film silver paste is fired in a belt-type continuous firing furnace by a profile of a temperature of 850° C. for a peak time of 6 minutes and an IN-OUT time of 45 minutes, thereby forming the upper surface electrode layers 12.

Next, a thick-film resistor paste containing ruthenium oxide as a main component is screen printed onto the upper surface of the sheet-shaped substrate so that it is electrically connected to the upper surface electrode layers 12, and thereafter the paste is dried. The thick-film resistor paste is dried in a belt-type continuous firing furnace by a profile of a temperature of 850° C. for a peak time of 6 minutes and an IN-OUT time of 45 minutes, thereby forming the resistor layer 13.

Next, a portion of the resistor layer 13 is cut using a laser light to adjust the resistance value (L cut, 30 mm/sec., 12 kHz, 5 W) so that the resistance value of the resistor layer 13 between the upper surface electrode layers 12 is uniform.

Next, the epoxy based resin paste is screen printed on the substrate so as to completely cover at least the resistor layer 13. Then, the epoxy resin paste is cured in a belt-type continuous curing furnace by a curing profile of a temperature of 200° C. for a peak time of 30 minutes and an IN-OUT time of 50 minutes, thereby forming the protection layer 14.

Next, in a preparing process for forming the end face electrode layers 15, the sheet-shaped substrate is divided into reed-shaped pieces and the end face sections for forming the end face electrode layers 15 are exposed.

Next, the reed-shaped substrate is secured using a holding jig with a concavo-convex surface so that an end face electrode-forming surface becomes flat.

Next, a carbon powder having a surface area of 800 $m^2/g$, a whisker-like potassium titanate coated with silver (average fiber diameter of 0.5 μm; average fiber length of 30 μm; aspect ratio of 60) as a whisker-like inorganic filler, a flake-like silver powder (average particle diameter of 5 μm; aspect ratio between a thickness and a particle diameter being 100) as a flake-like conductive powder, and an epoxy resin-containing solution containing an epoxy resin having a molecular weight of 800 (solvent: diethylene glycol monomethyl ether having a boiling point of 194° C.; solvent content: 55 volume %) are mixed at a volume ratio of 14:5:6:75, and a suitable amount of diethylene glycol monobutyl ether acetate is added thereto so as to allow the mixed material to have a viscosity of 800 Pa·s at a shear rate of 0.006 (l/s) to knead thus obtained mixed material (solvent content: 65 volume %) by a three-roll mill, thereby preparing an end face electrode paste. The mixing ratio (mass ratio) between the conductive particles and the epoxy resin contained in the above mixed material is 77:23. A thick-film end face electrode paste having a uniform thickness of about 50 μm is preliminary provided on a stainless steel roller. Then, by rotating the stainless steel roller and by moving the holding jig with a concavo-convex surface, the end face electrode paste on the stainless steel roller is brought in contact with the end face electrode-forming surface of the reed-shaped substrate so as to cover at least portions of the upper surface electrode layers 12, and thereby the mixed material is applied to the substrate end faces. Subsequently, the application status of the mixed material is confirmed using an image recognition apparatus. The substrate, in which it has been confirmed that the end face electrode paste was applied throughout the end face electrode-forming surface of the reed-shaped substrate without application deficiency, is subjected to a heating process using a belt-type continuous far-infrared curing furnace by a temperature profile of a peak time of 30 minutes at 160° C. and an IN-OUT time of 40 minutes. According to the above-described process, end face electrode layers 15 having a thickness of end face sections of about 5 to 10 μm are formed.

Finally, as a preparation process of electroplating, the reed-shaped substrate is divided into individual pieces. The nickel-plated layers 16 and the solder- or tin-plated layers 17 are formed on the exposed portions of the upper surface electrode layers 12 and the end face electrode layers 15 of the individual piece substrate, respectively, by a barrel processing-type electroplating, thereby producing the rectangular chip resistor.

In the rectangular chip resistor according to the first embodiment of the present invention, the weight reduction rate of the end face electrode layer when heated at a temperature of 200° C. is 0.09%, and the solder splashing rate is 0%. The other characteristics are indicated in Table 1 below.

Second Embodiment

A rectangular chip resistor according to a second embodiment of the invention will now be described.

The rectangular chip resistor according to the second embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The process for producing the rectangular chip resistor according to the second embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 800 (solvent of diethylene glycol monomethyl ether having a boiling point of about 194° C.; solvent content of 55 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 65 volume %) is kneaded by a three roll mill. The mixing ratio (mass ratio) between the conductive particles and the epoxy resin contained in the above mixed material is 72:28. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described second embodiment of the invention, since the carbon powder, the whisker-like inorganic filler coated with silver, the flake-like silver powder, and the epoxy resin-containing solution are mixed at a volume ratio of 10:3:6:81, the strength of the electrode can be improved compared to that in the first embodiment of the invention. The other characteristics are represented in Table 1 below.

Third Embodiment

A rectangular chip resistor according to a third embodiment of the invention will now be described.

The rectangular chip resistor according to the third embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the third embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 1,000 (solvent of diethylene glycol monomethyl ether having a boiling point of about 194° C.; solvent content of 60 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 70 volume %) is kneaded by a three roll mill. The mixing ratio (mass ratio) between the conductive particles and the epoxy resin contained in the above mixed material is 74:26. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described third embodiment of the invention, since the molecular weight of the epoxy resin forming the end face electrode layers 15 is 1,000 (a preferable molecular weight is between 1,000 and 80,000), an epoxy resin-containing solution having a solvent content of 60 volume % (a preferable solvent content is equal to or more than 60 volume %) can be used. Accordingly, coatability of the substrate edge portions is improved compared to that in the second embodiment of the invention. The other characteristics are represented in Table 1 below.

Fourth Embodiment

A rectangular chip resistor according to a fourth embodiment of the invention will now be described.

The rectangular chip resistor according to the fourth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fourth embodiment of the invention will now be described.

The process before securing the reed-shaped substrate by using a holding jig with a concavo-convex surface so as to make the end face electrode-forming surface flat is similar to that of the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of diethylene glycol monomethyl ether having a boiling point of about 194° C.; solvent content of 66 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 74 volume %) is kneaded by a three roll mill. The mixing ratio (mass ratio) between the conductive particles and the epoxy resin contained in the above mixed material is 77:23. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the fourth embodiment of the above-described invention, since the molecular weight of the epoxy resin contained in the end face electrode layers 15 is 50,000 (a preferable molecular weight is between 1,000 and 80,000), an epoxy resin-containing solution having a solvent content of 66 volume % (preferable solvent content is equal to or more than 60 volume %) can be used. Accordingly, coatability of the substrate edge portions is improved compared to that in the second embodiment of the invention. The other characteristics are represented in Table 1 below.

Fifth Embodiment

A rectangular chip resistor according to a fifth embodiment of the invention will now be described.

The rectangular chip resistor according to the fifth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifth embodiment of the invention will now be described.

The process before securing the reed-shaped substrate by using a holding jig with a concavo-convex surface so as to make the end face electrode-forming surface flat is similar to that of the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 80,000 (solvent of diethylene glycol monomethyl ether having a boiling point of about 194° C.; solvent content of 75 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 84 volume %) is kneaded by a three roll mill. The mixing ratio (mass ratio) between the conductive particles and the epoxy resin contained in the above mixed material is 82:18. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifth embodiment of the invention, since the epoxy resin forming the end face electrode layers 15 has a molecular weight of 80,000 (preferable molecular weight thereof is between 1,000 and 80,000), an epoxy resin-containing solution of a solvent content of 75 volume % (preferable solvent content thereof is equal to or more than 60 volume %) can be used. Accordingly, coatability of the substrate edge portions is improved compared to that in the second embodiment of the invention. The other characteristics are represented in Table 1 below.

Sixth Embodiment

A rectangular chip resistor according to a sixth embodiment of the invention will now be described.

The rectangular chip resistor according to the sixth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the sixth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 100,000 (solvent of diethylene glycol monomethyl ether having a boiling point of about 194° C.; solvent content of 80 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 89 volume %) is kneaded by a three roll mill. The mixing ratio (mass ratio) between the conductive particles and the epoxy resin contained in the above mixed material is 85:15. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described sixth embodiment of the invention, since the epoxy resin forming the end face electrode layers 15 has a molecular weight of 100,000, an epoxy resin-containing solution having a solvent content of 80 volume % (a solvent content equal to or more than 60 volume % is preferable) can be used. However, since the molecular weight of the epoxy resin of 100,000 is too large, the film thickness in its entirety becomes thinner. Accordingly, coatability of the substrate edge portions tends to decrease in its entirety compared to those according to the other embodiments of the invention. The other characteristics are represented in the following Table 1.

TABLE 1

| | | Unit | First Embodiment | Second Embodiment | Third Embodiment | Fourth Embodiment | Fifth Embodiment | Sixth Embodiment |
|---|---|---|---|---|---|---|---|---|
| Mixing ratio (volume ratio) | Carbon powder | (%) | 14 | 10 | 10 | 10 | 10 | 10 |
| | Whisker-like inorganic filler | (%) | 5 | 3 | 3 | 3 | 3 | 3 |
| | Flake-like conductive powder | (%) | 6 | 6 | 6 | 6 | 6 | 6 |
| | Epoxy resin containing liquid | (%) | 75 | 81 | 81 | 81 | 81 | 81 |
| Molecular weight of epoxy resin | | — | 800 | 800 | 1,000 | 50,000 | 80,000 | 100,000 |
| Boiling point of solvent | | (° C.) | 194 | 194 | 194 | 194 | 194 | 194 |
| Solvent content of epoxy resin containing liquid | | (%) | 55 | 55 | 60 | 66 | 75 | 80 |
| Surface area of carbon powder per 1 g | | $m^2$ | 800 | 800 | 800 | 800 | 800 | 800 |
| Whisker-like inorganic filler | Material | — | Potassium titanate | Potassium titanate | Potassium titanate | Potassium titanate | Potassium titanate | Potassium titanate |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | coated conductive material | — | Silver | Silver | Silver | Silver | Silver | Silver |
| Flake-like conductive powder | Material | — | Silver | Silver | Silver | Silver | Silver | Silver |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 800 | 800 | 800 | 800 | 800 | 800 |
| Coupling agent | | (%) | 0 | 0 | 0 | 0 | 0 | 0 |
| Weight reduction | | (%) | 0.09 | 0.09 | 0.03 | 0.03 | 0.03 | 0.03 |
| Solder splash | | (number) | 0 | 0 | 0 | 0 | 0 | 0 |
| Plating | Plating quality | — | Thin | Thin | Thin | Thin | Thin | Thin |
| | Adhesiveness | — | Weak | Weak | Weak | Weak | Weak | Weak |
| Electrode strength | | (N) | 200 | 230 | 230 | 230 | 230 | 230 |
| Edge film thickness | | — | Thin | Thin | Good | Good | Good | Thin in the entirety of the film |
| Flow of mixed material on substrate | | — | Large | Large | Large | Large | Large | Large |
| Viscosity change during operation | | — | Yes | Yes | Yes | Yes | Yes | Yes |
| Application status (Thickness accuracy) | | — | Variation large | Variation large | Good | Good | Good | Good |
| Material cost | | — | B | B | B | B | B | B |
| Volume content of solvent in mixed material | | (%) | 65 | 65 | 70 | 74 | 84 | 89 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than 5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Seventh Embodiment

A rectangular chip resistor according to a seventh embodiment of the invention will now be described.

The rectangular chip resistor according to the seventh embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the seventh embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface fiat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monoethyl ether having a boiling point of about 202° C.; solvent content of 66 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 74 volume %) is kneaded by a three roll mill. The mixing ratio (mass ratio) between the conductive particles and the epoxy resin contained in the above mixed material is 77:23. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described seventh embodiment of the invention, since the solvent contained in the epoxy resin-containing solution forming the end face electrode layers 15 is a diethylene glycol monoethyl ether having a boiling point of about 202° C. (a solvent having a boiling point equal to or more than 200° C. is preferable), the rate of vaporization of the solvent contained in the end face electrode paste becomes less. Accordingly, viscosity change of the end face electrode paste in the production process can be minimized. Therefore, stable application of the end face electrode paste can be achieved compared to those according to the first through sixth embodiments of the invention. The other characteristics are represented in Table 2 below.

Eighth Embodiment

A rectangular chip resistor according to an eighth embodiment of the invention will now be described.

The rectangular chip resistor according to the eighth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the eight embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 10:3:6:81; a suitable amount of diethylene glycol monobutyl ether acetate is added thereto so as to obtain a viscosity of 800 Pa·s at a shear rate of 0.006 (l/s); and the resulting mixed material (solvent content of 74 volume %) is kneaded by a three roll mill. The mixing ratio (mass ratio) between the conductive particles and the epoxy resin contained in the above mixed material is 77:23. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described eighth embodiment of the invention, since the solvent contained in the epoxy resin-containing solution forming the end face electrode layers 15 is a diethylene glycol monobutyl ether acetate having a boiling point of about 247° C. (a solvent having a boiling point equal to or more than about 200° C. is preferable), the rate of vaporization of the solvent contained in the end face electrode paste becomes less. Accordingly, viscosity change of the end face electrode paste in the production process can be minimized. Therefore, stable application of the end face electrode paste can be achieved comparing to those according to the first through sixth embodiments of the invention. The other characteristics are represented in Table 2 below.

Ninth Embodiment

A rectangular chip resistor according to a ninth embodiment of the invention will now be described.

The rectangular chip resistor according to the ninth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the ninth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 9:5:6:80; a suitable amount of diethylene glycol monobutyl ether acetate is added thereto so as to obtain a viscosity of 800 Pa·s at a shear rate of 0.006 (l/s); and the resulting mixed material (solvent content of 74 volume %) is kneaded by a three roll mill. The mixing ratio (mass ratio) between the conductive particles and the epoxy resin contained in the above mixed material is 82:18. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end faces of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that of the first embodiment of the invention.

In the above-described ninth embodiment of the invention, since the carbon powder, the whisker-like potassium titanate coated with silver (average fiber diameter of 0.5 μm; average fiber length of 30 μm; aspect ratio of 60) as the whisker-like inorganic filler, the flake-like silver powder (average particle diameter of 5 μm; aspect ratio between a thickness and a particle diameter of 100) as the flake-like conductive powder, and the epoxy resin-containing solution containing an epoxy resin having a molecular weight of 50,000 (solvent of the diethylene glycol monobutyl ether acetate having a boiling point of about 247° C.; solvent content of 66 volume %) are mixed at a volume ratio of 9:5:6:80, the area resistance value becomes less compared to those according to the seventh embodiment and the eighth embodiment of the invention. Thus, plating stability and strength of the electrode are improved. The other characteristics are represented in Table 2 below.

Tenth Embodiment

A rectangular chip resistor according to a tenth embodiment of the invention will now be described.

The rectangular chip resistor according to the tenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the tenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a suitable amount of diethylene glycol monobutyl ether acetate is added thereto so as to obtain a viscosity of 800 Pa·s at a shear rate of 0.006 (l/s); and the resulting mixed material (solvent content of 74 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end faces of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described tenth embodiment of the invention, since the carbon powder, the whisker-like potassium titanate coated with silver (average fiber diameter of 0.5 μm; average fiber length of 30 μm; aspect ratio of 60) as the whisker-like inorganic filler, the flake-like silver powder (average particle diameter of 5 μm; aspect ratio between a thickness and a particle diameter of 100) as the flake-like conductive powder, and the epoxy resin-containing solution containing an epoxy resin having a molecular weight of 50,000 (solvent of the diethylene glycol monobutyl ether acetate having a boiling point of about 247° C.; solvent content of 66 volume %) are mixed at a volume ratio of 7:5:8:80, the area resistance value becomes less compared to those according to the seventh embodiment and the eighth embodiment of the invention. Thus, plating stability and strength of the electrode are improved. The other characteristics are represented in Table 2 below.

Eleventh Embodiment

A rectangular chip resistor according to an eleventh embodiment of the invention will now be described.

The rectangular chip resistor according to the eleventh embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the eleventh embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 800 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 4:7:9:80; a suitable amount of diethylene glycol monobutyl ether acetate is added thereto so as to obtain a viscosity of 800 Pa·s at a shear rate of 0.006 (l/s); and the resulting mixed material (solvent content of 74 volume %) is kneaded by a three roll mill. The mixing ratio (mass ratio) between the conductive particles and the epoxy resin contained in the above mixed material is 83:17. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end faces of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described eleventh embodiment of the invention, since the carbon powder, the whisker-like potassium titanate coated with silver (average fiber diameter of 0.5 μm; average fiber length of 30 μm; aspect ratio of 60) as the whisker-like inorganic filler, the flake-like silver powder (average particle diameter of 5 μm; aspect ratio between a thickness and a particle diameter of 100) as the flake-like conductive powder, and the epoxy resin-containing solution containing an epoxy resin having a molecular weight of 50,000 (solvent of diethylene glycol monobutyl ether acetate having a boiling point of about 247° C.; solvent content of 66 volume %) are mixed at the volume ratio of 4:7:9:80, the area resistance value becomes less compared to those according to the seventh embodiment and the eighth embodiment. Thus, plating stability and strength of the electrode are improved. The other characteristics are represented in Table 2 below.

Twelfth Embodiment

A rectangular chip resistor according to a twelfth embodiment of the invention will now be described.

The rectangular chip resistor according to the twelfth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twelfth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode paste is formed so as to cover at least portions of the upper surface electrode layers 12 in the following manner. An end face electrode paste is prepared in such a way that: a carbon powder having a surface area of 1,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a suitable amount of diethylene glycol monobutyl ether acetate is added thereto so as to obtain a viscosity of 1,000 Pa·s at a shear rate of 0.006 (l/s); and the resulting mixed material (solvent content of 77 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twelfth embodiment of the invention, since the carbon powder has a surface area of 1,000 $m^2/g$ (surface area equal to or more than 1,000 $m^2/g$ is preferable), a mixed material having a viscosity of 1,000 Pa·s at a shear rate of 0.006 (l/s) can be obtained (viscosity equal to or more than 1,000 Pa·s is preferable). Thus, the mixed material is suppressed from flowing onto the substrate compared to those according to the ninth through eleventh embodiments of the invention. The other characteristics are represented in the following Table 2.

TABLE 2

| | | Unit | Seventh Embodiment | Eighth Embodiment | Ninth Embodiment | Tenth Embodiment | Eleventh Embodiment | Twelfth Embodiment |
|---|---|---|---|---|---|---|---|---|
| Mixing ratio (volume ratio) | Carbon powder | (%) | 10 | 10 | 9 | 7 | 4 | 7 |
| | Whisker-like inorganic filler | (%) | 3 | 3 | 5 | 5 | 7 | 5 |
| | Flake-like conductive powder | (%) | 6 | 6 | 6 | 8 | 9 | 8 |
| | Epoxy resin containing liquid | (%) | 81 | 81 | 80 | 80 | 80 | 80 |
| Molecular weight of epoxy resin | | — | 50000 | 50000 | 50000 | 50000 | 50000 | 50000 |
| Boiling point of solvent | | (° C.) | 202 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 800 | 800 | 800 | 800 | 800 | 1000 |
| Whisker-like inorganic filler | Material | — | Potassium titanate | Potassium titanate | Potassium titanate | Potassium titanate | Potassium titanate | Potassium titanate |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | Coated conductive material | — | Silver | Silver | Silver | Silver | Silver | Silver |
| Flake-like conductive powder | Material | — | Silver | Silver | Silver | Silver | Silver | Silver |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 800 | 800 | 800 | 800 | 800 | 1000 |
| Coupling agent | | (%) | 0 | 0 | 0 | 0 | 0 | 0 |
| Weight reduction | | (%) | 0.04 | 0.04 | 0.04 | 0.04 | 0.04 | 0.08 |
| Solder splash | | (number) | 0 | 0 | 0 | 0 | 0 | 0 |
| Plating | Plating quality | — | Thin | Thin | Good | Good | Good | Good |
| | Adhesiveness | — | Weak | Weak | Weak | Good | Good | Good |
| Electrode strength | | (N) | 230 | 230 | 280 | 280 | 280 | 280 |
| Edge film thickness | | — | Good | Good | Good | Good | Good | Good |
| Flow of mixed material on substrate | | — | Large | Large | Large | Large | Large | Good |
| Viscosity change during operation | | — | No | No | No | No | No | No |
| Application status (Thickness accuracy) | | — | Good | Good | Good | Good | Good | Good |
| Material cost | | — | B | B | B | B | C | B |
| Volume content of solvent in mixed material | | (%) | 74 | 74 | 74 | 74 | 74 | 77 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Thirteenth Embodiment

A rectangular chip resistor according to a thirteenth embodiment of the invention will now be described.

The rectangular chip resistor according to the thirteenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirteenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a suitable amount of diethylene glycol monobutyl ether acetate is added thereto so as to obtain a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirteenth embodiment of the invention, since the carbon powder has a surface area equal to or more than 2,000 $m^2/g$ (surface area equal to or more than 1,000 $m^2/g$ is preferable), a mixed material having a viscosity of 2,000 Pa·s (viscosity equal to or more than 1,000 Pa·s is preferable) can be obtained at a shear rate of 0.006 (l/s). Thus, the mixed material can be suppressed from flowing onto the substrate compared to those according to the ninth through eleventh embodiments of the invention. The other characteristics are represented in Table 3 below.

Fourteenth Embodiment

A rectangular chip resistor according to a fourteenth embodiment of the invention will now be described.

The rectangular chip resistor according to the fourteenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fourteenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fourteenth embodiment of the invention, since the silane based coupling agent is added to the mixed material in 1 volume %, adhesion between the substrate and the mixed material is improved compared to those according to the twelfth embodiment and the thirteenth embodiment of the invention. This enables the strength of the electrode to improve to 320 N. The other characteristics are represented in Table 3 below.

Fifteenth Embodiment

A rectangular chip resistor according to a fifteenth embodiment of the invention will now be described.

The rectangular chip resistor according to the fifteenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifteenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like silica coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that of the first embodiment of the invention.

In the above-described fifteenth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 3 below.

Sixteenth Embodiment

A rectangular chip resistor according to a sixteenth embodiment of the invention will now be described.

The rectangular chip resistor according to the sixteenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the sixteenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like wollastonite coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described sixteenth embodiment, since the silane based coupling agent is added to the mixed material in 1 volume %, adhesion between the substrate and the mixed material is improved compared to those in the twelfth embodiment and the thirteenth embodiment of the invention, enabling the strength of the electrode to improve to 320 N. The other characteristics are represented in Table 3 below.

Seventeenth Embodiment

A rectangular chip resistor according to a seventeenth embodiment of the invention will now be described.

The rectangular chip resistor according to the seventeenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the seventeenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like sepiolite coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described seventeenth embodiment of the invention, since the silane based coupling agent of 1 volume % is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 3 below.

Eighteenth Embodiment

A rectangular chip resistor according to an eighteenth embodiment of the invention will now be described.

The rectangular chip resistor according to the eighteenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the eighteenth embodiment of the invention will now be described.

The process before securing the reed-shaped substrate by using a holding jig with a concavo-convex surface so as to make the end face electrode-forming surface flat is similar to that of the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like zinc oxide coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described eighteenth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in the following Table 3.

TABLE 3

| | | Unit | Thirteenth Embodiment | Fourteenth Embodiment | Fifteenth Embodiment | Sixteenth Embodiment | Seventeenth Embodiment | Eighteenth Embodiment |
|---|---|---|---|---|---|---|---|---|
| Mixing ratio (volume ratio) | Carbon powder | (%) | 7 | 7 | 7 | 7 | 7 | 7 |
| | Whisker-like inorganic filler | (%) | 5 | 5 | 5 | 5 | 5 | 5 |
| | Flake-like conductive powder | (%) | 8 | 8 | 8 | 8 | 8 | 8 |
| | Epoxy resin containing liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 2000 | 2000 | 2000 | 2000 | 2000 | 2000 |
| Whisker-like inorganic filler | Material | — | Potassium titanate | Potassium titanate | Silica | Wollastonite | Sepiolite | Zinc oxide |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | Coated conductive material | — | Silver | Silver | Silver | Silver | Silver | Silver |
| Flake-like conductive powder | Material | — | Silver | Silver | Silver | Silver | Silver | Silver |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 2000 | 2000 | 2000 | 2000 | 2000 | 2000 |
| Coupling agent | | (%) | 0 | 1 | 1 | 1 | 1 | 1 |
| Weight reduction | | (%) | 0.08 | 0.07 | 0.03 | 0.05 | 0.05 | 0.05 |
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 280 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |
| Application status (Thickness accuracy) | | — | Good | Good | Good | Good | Good | Good |
| Material cost | | — | B | B | B | B | B | B |
| Volume content of solvent in mixed material | | (%) | 80 | 80 | 80 | 80 | 80 | 80 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Nineteenth Embodiment

A rectangular chip resistor according to a nineteenth embodiment of the invention will now be described.

The rectangular chip resistor according to the nineteenth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the nineteenth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like calcium carbonate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace with a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described nineteenth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 4 below.

Twentieth Embodiment

A rectangular chip resistor according to a twentieth embodiment of the invention will now be described.

The rectangular chip resistor according to the twentieth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twentieth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like titanic oxide coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twentieth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 4 below.

Twenty-first Embodiment

A rectangular chip resistor according to a twenty-first embodiment of the invention will now be described.

The rectangular chip resistor according to the twenty-first embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-first embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like barium sulfate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-first embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 4 below.

Twenty-second Embodiment

A rectangular chip resistor according to a twenty-second embodiment of the invention will now be described.

The rectangular chip resistor according to the twenty-second embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-second embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like aluminum hydroxide coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-second embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 4 below.

Twenty-third Embodiment

A rectangular chip resistor according to a twenty-third embodiment of the invention will now be described.

The rectangular chip resistor according to the twenty-third embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-third embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like aluminum oxide coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace with a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that of the first embodiment of the invention.

In the above-described twenty-third embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 4 below.

Twenty-fourth Embodiment

A rectangular chip resistor according to a twenty-fourth embodiment of the invention will now be described.

The rectangular chip resistor according to the twenty-fourth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-fourth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like magnesium hydroxide coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace with a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-fourth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in the following Table 4.

TABLE 4

| | | Unit | Nineteenth Embodiment | Twentieth Embodiment | Twenty-first Embodiment | Twenty-second Embodiment | Twenty-third Embodiment | Twenty-fourth Embodiment |
|---|---|---|---|---|---|---|---|---|
| Mixing ratio (volume ratio) | Carbon powder | (%) | 7 | 7 | 7 | 7 | 7 | 7 |
| | Whisker-like inorganic filler | (%) | 5 | 5 | 5 | 5 | 5 | 5 |
| | Flake-like conductive powder | (%) | 8 | 8 | 8 | 8 | 8 | 8 |
| | Epoxy resin containing liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 2000 | 2000 | 2000 | 2000 | 2000 | 2000 |
| Whisker-like inorganic filler | Material | — | Calcium carbonate | Titanic oxide | Barium sulfate | Aluminum hydroxide | Aluminum oxide | Magnesium hydroxide |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | Coated conductive material | — | Silver | Silver | Silver | Silver | Silver | Silver |
| Flake-like conductive powder | Material | — | Silver | Silver | Silver | Silver | Silver | Silver |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 2000 | 2000 | 2000 | 2000 | 2000 | 2000 |
| Coupling agent | | (%) | 1 | 1 | 1 | 1 | 1 | 1 |
| Weight reduction | | (%) | 0.07 | 0.08 | 0.04 | 0.03 | 0.03 | 0.03 |
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 320 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |
| Application status (Thickness accuracy) | | — | Good | Good | Good | Good | Good | Good |
| Material cost | | — | B | B | B | B | B | B |
| Volume content of solvent in mixed material | | (%) | 80 | 80 | 80 | 80 | 80 | 80 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more then 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Twenty-fifth Embodiment

A rectangular chip resistor according to a twenty-fifth embodiment of the invention will now be described.

The rectangular chip resistor according to the twenty-fifth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-fifth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like xonotlite coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-fifth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 5 below.

Twenty-sixth Embodiment

A rectangular chip resistor according to a twenty-sixth embodiment of the invention will now be described.

The rectangular chip resistor according to the twenty-sixth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-sixth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like aluminum borate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-sixth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 5 below.

Twenty-seventh Embodiment

A rectangular chip resistor according to a twenty-seventh embodiment of the invention will now be described.

The rectangular chip resistor according to the twenty-seventh embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-seventh embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like magnesium sulfate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 82 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-seventh embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 5 below.

Twenty-eighth Embodiment

A rectangular chip resistor according to a twenty-eighth embodiment of the invention will now be described.

The rectangular chip resistor according to the twenty-eighth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-eighth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like calcium silicate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 78 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-eighth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 5 below.

Twenty-ninth Embodiment

A rectangular chip resistor according to a twenty-ninth embodiment of the invention will now be described.

The rectangular chip resistor according to the twenty-ninth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the twenty-ninth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like silicon nitride coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described twenty-ninth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 5 below.

Thirtieth Embodiment

A rectangular chip resistor according to a thirtieth embodiment of the invention will now be described.

The rectangular chip resistor according to the thirtieth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirtieth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like silicon carbide coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirtieth embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in the following Table 5.

TABLE 5

| | | Unit | Twenty-fifth Embodiment | Twenty-sixth Embodiment | Twenty-seventh Embodiment | Twenty-eighth Embodiment | Twenty-ninth Embodiment | Thirtieth Embodiment |
|---|---|---|---|---|---|---|---|---|
| Mixing ratio (volume ratio) | Carbon powder | (%) | 7 | 7 | 7 | 7 | 7 | 7 |
| | Whisker-like ionrganic filler | (%) | 5 | 5 | 5 | 5 | 5 | 5 |
| | Flake-like conductive powder | (%) | 8 | 8 | 8 | 8 | 8 | 8 |
| | Epoxy resin containing liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 2000 | 2000 | 2000 | 2000 | 2000 | 2000 |
| Whisker-like inorganic filler | Material | — | Xonotlite | Aluminum borate | Magnesium sulfate | Calcium silicate | Silicon nitride | Silicon corbide |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | Coated conductive material | — | Sliver | Sliver | Sliver | Sliver | Sliver | Sliver |
| Flake-like conductive powder | Material | — | Sliver | Sliver | Sliver | Sliver | Sliver | Sliver |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 2000 | 2000 | 2000 | 2000 | 2000 | 2000 |
| Coupling agent | | (%) | 1 | 1 | 1 | 1 | 1 | 1 |
| Weight reduction | | (%) | 0.07 | 0.05 | 0.03 | 0.03 | 0.02 | 0.01 |
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 320 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |
| Application status (Thickness accuracy) | | — | Good | Good | Good | Good | Good | Good |
| Material cost | | — | B | B | B | B | B | B |
| Volume content of solvent in mixed material | | (%) | 80 | 80 | 82 | 78 | 80 | 80 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Thirty-first Embodiment

A rectangular chip resistor according to a thirty-first embodiment of the invention will now be described.

The rectangular chip resistor according to the thirty-first embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-first embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2$/g, a whisker-like potassium titanate coated with nickel (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace with a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-first embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 6 below.

Thirty-second Embodiment

A rectangular chip resistor according to a thirty-second embodiment of the invention will now be described.

The rectangular chip resistor according to the thirty-second embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-second embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with gold (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 60° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-second embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 6 below. tThirty-Third Embodiment A rectangular chip resistor according to a thirty-third embodiment of the invention will now be described.

The rectangular chip resistor according to the thirty-third embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-third embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with tin (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80;

a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-third embodiment of the invention, since the silane based coupling agent of 1 volume % is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 6 below.

Thirty-fourth Embodiment

A rectangular chip resistor according to a thirty-fourth embodiment of the invention will now be described.

The rectangular chip resistor according to the thirty-fourth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-fourth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with copper (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-fourth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 6 below.

Thirty-fifth Embodiment

A rectangular chip resistor according to a thirty-fifth embodiment of the invention will now be described.

The rectangular chip resistor according to the thirty-fifth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-fifth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with platinum (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace with a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-fifth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 6 below.

Thirty-sixth Embodiment

A rectangular chip resistor according to a thirty-sixth embodiment of the invention will now be described.

The rectangular chip resistor according to the thirty-sixth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-sixth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with solder (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-sixth embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in the following Table 6.

TABLE 6

| | | Unit | Thirty-first Embodiment | Thirty-second Embodiment | Thirty-third Embodiment | Thirty-fourth Embodiment | Thirty-fifth Embodiment | Thirty-sixth Embodiment |
|---|---|---|---|---|---|---|---|---|
| Mixing ratio (volume ratio) | Carbon powder | (%) | 7 | 7 | 7 | 7 | 7 | 7 |
| | Whisker-like ionrganic filler | (%) | 5 | 5 | 5 | 5 | 5 | 5 |
| | Flake-like conductive powder | (%) | 8 | 8 | 8 | 8 | 8 | 8 |
| | Epoxy resin containing liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 2000 | 2000 | 2000 | 2000 | 2000 | 2000 |
| Whisker-like inorganic filler | Material | — | Potassium titanate | Potassium titanate | Potassium titanate | Potassium titanate | Potassium titanate | Potassium titanate |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | Coated conductive material | — | Nickel | Gold | Tin | Copper | platinum | Solder |
| Flake-like conductive powder | Material | — | Sliver | Sliver | Sliver | Sliver | Sliver | Sliver |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 2000 | 2000 | 2000 | 2000 | 2000 | 2000 |
| Coupling agent | | (%) | 1 | 1 | 1 | 1 | 1 | 1 |
| Weight reduction | | (%) | 0.02 | 0.01 | 0.04 | 0.06 | 0.03 | 0.02 |
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 320 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |
| Application status (Thickness accuracy) | | — | Good | Good | Good | Good | Good | Good |
| Material cost | | — | A | c | A | A | C | A |
| Volume content of solvent in mixed material | | (%) | 80 | 80 | 80 | 80 | 80 | 80 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Thirty-seventh Embodiment

A rectangular chip resistor according to a thirty-seventh embodiment of the invention will now be described.

The rectangular chip resistor according to the thirty-seventh embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-seventh embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2$/g, a whisker-like potassium titanate coated with silver (average fiber diameter of 0.1 μm; average fiber length of 1 μm; aspect ratio of 10) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-seventh embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 7 below.

Thirty-eighth Embodiment

A rectangular chip resistor according to a thirty-eighth embodiment of the invention will now be described.

The rectangular chip resistor according to the thirty-eighth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-eighth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 1 μm; average fiber length of 100 μm; aspect ratio of 100) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pass at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-eighth embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 7 below.

Thirty-ninth Embodiment

A rectangular chip resistor according to a thirty-ninth embodiment of the invention will now be described.

The rectangular chip resistor according to the thirty-ninth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the thirty-ninth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 1 μm; average fiber length of 10 μm; aspect ratio of 10) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described thirty-ninth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 7 below.

Fortieth Embodiment

A rectangular chip resistor according to a fortieth embodiment of the invention will now be described.

The rectangular chip resistor according to the fortieth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fortieth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like graphite coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fortieth embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 7 below.

Forty-first Embodiment

A rectangular chip resistor according to a forty-first embodiment of the invention will now be described.

The rectangular chip resistor according to the forty-first embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-first embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like copper powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80;

a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-first embodiment, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 7 below.

Forty-second Embodiment

A rectangular chip resistor according to a forty-second embodiment of the invention will now be described.

The rectangular chip resistor according to the forty-second embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-second embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like nickel powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-second embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in the following Table 7.

TABLE 7

| | | Unit | Thirty-seventh Embodiment | Thirty-eighth Embodiment | Thirty-ninth Embodiment | Fortieth Embodiment | Forty-first Embodiment | Forty-second Embodiment |
|---|---|---|---|---|---|---|---|---|
| Mixing ratio (volume ratio) | Carbon powder | (%) | 7 | 7 | 7 | 7 | 7 | 7 |
| | Whisker-like inorganic filler | (%) | 5 | 5 | 5 | 5 | 5 | 5 |
| | Flake-like conductive powder | (%) | 8 | 8 | 8 | 8 | 8 | 8 |
| | Epoxy resin containing Liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |

TABLE 7-continued

| | | Unit | Thirty-seventh Embodiment | Thirty-eighth Embodiment | Thirty-ninth Embodiment | Fortieth Embodiment | Forty-first Embodiment | Forty-second Embodiment |
|---|---|---|---|---|---|---|---|---|
| Surface area of carbon powder per 1 g | | $m^2$ | 2000 | 2000 | 2000 | 2000 | 2000 | 2000 |
| Whisker-like inorganic filler | Material | — | Potassium titanate | Potassium titanate | Potassium titanate | Graphite | Potassium titanate | Potassium titanate |
| | Average fiber diameter | (μm) | 0.1 | 1 | 1 | 0.5 | 0.5 | 0.5 |
| | Average fiber length | (μm) | 1 | 100 | 10 | 30 | 30 | 30 |
| | Aspect ratio | — | 10 | 100 | 10 | 60 | 60 | 60 |
| | Coated conductive material | — | Silver | Silver | Sliver | Sliver | Sliver | Silver |
| Flake-like conductive powder | Material | — | Silver | Silver | Silver | Sliver | Copper | Nickel |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 2000 | 2000 | 2000 | 2000 | 2000 | 2000 |
| Coupling agent | | (%) | 1 | 1 | 1 | 1 | 1 | 1 |
| Weight reduction | | (%) | 0.04 | 0.05 | 0.06 | 0.05 | 0.03 | 0.02 |
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 320 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |
| Application status (Thickness accuracy) | | — | Good | Good | Good | Good | Good | Good |
| Material cost | | — | B | B | B | B | A | A |
| Volume content of solvent in mixed material | | (%) | 80 | 80 | 80 | 80 | 80 | 80 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more then 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Forty-third Embodiment

A rectangular chip resistor according to a forty-third embodiment of the invention will now be described.

The rectangular chip resistor according to the forty-third embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-third embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-third embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 8 below.

Forty-fourth Embodiment

A rectangular chip resistor according to a forty-fourth embodiment of the invention will now be described.

The rectangular chip resistor according to the forty-fourth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-fourth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like copper powder coated with silver (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-fourth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 8 below.

Forty-fifth Embodiment

A rectangular chip resistor according to a forty-fifth embodiment of the invention will now be described.

The rectangular chip resistor according to the forty-fifth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-fifth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like copper powder coated with gold (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-fifth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 8 below.

Forty-sixth Embodiment

A rectangular chip resistor according to a forty-sixth embodiment of the invention will now be described.

The rectangular chip resistor according to the forty-sixth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-sixth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like copper powder coated with platinum (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volumes) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-sixth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 8 below.

Forty-seventh Embodiment

A rectangular chip resistor according to a forty-seventh embodiment of the invention will now be described.

The rectangular chip resistor according to the forty-seventh embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-seventh embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like copper powder coated with solder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-seventh embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 8 below.

Forty-eighth Embodiment

A rectangular chip resistor according to a forty-eighth embodiment of the invention will now be described.

The rectangular chip resistor according to the forty-eighth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-eighth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like nickel powder coated with silver (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (1/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-eighth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in the following Table 8.

TABLE 8

| | | Unit | Forty-third Embodiment | Forty-fourth Embodiment | Forty-fifth Embodiment | Forty-sixth Embodiment | Forty-seventh Embodiment | Forty-eighth Embodiment |
|---|---|---|---|---|---|---|---|---|
| Mixing ratio (volume ratio) | Carbon powder | (%) | 7 | 7 | 7 | 7 | 7 | 7 |
| | Whisker-like inorganic filler | (%) | 5 | 5 | 5 | 5 | 5 | 5 |
| | Flake-like conductive powder | (%) | 8 | 8 | 8 | 8 | 8 | 8 |
| | Epoxy resin containing Liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 2000 | 2000 | 2000 | 2000 | 2000 | 2000 |
| Whisker-like inorganic filler | Material | — | Potassium titanate | Potassium titanate | Potassium titanate | Potassium titanate | Potassium titanate | Potassium titanate |
| | Average fiber diameter | (μm) | 0.5 | 0.5 | 0.5 | 0.5 | 0.5 | 0.5 |
| | Average fiber length | (μm) | 30 | 30 | 30 | 30 | 30 | 30 |
| | Aspect ratio | — | 60 | 60 | 60 | 60 | 60 | 60 |
| | Coated conductive material | — | Silver | Silver | Sliver | Sliver | Sliver | Silver |
| Flake-like conductive powder | Material | — | Tin | Silver coated copper | Gold coated copper | Platinum coated copper | Solder coated copper | Silver coated nickel |
| | Average particle diameter | (μm) | 5 | 5 | 5 | 5 | 5 | 5 |
| | Aspect ratio | — | 100 | 100 | 100 | 100 | 100 | 100 |
| Viscosity at 0.006 (1/s) | | (Pa · s) | 2000 | 2000 | 2000 | 2000 | 2000 | 2000 |
| Coupling agent | | (%) | 1 | 1 | 1 | 1 | 1 | 1 |
| Weight reduction | | (%) | 0.05 | 0.05 | 0.07 | 0.08 | 0.03 | 0.03 |

TABLE 8-continued

| | | Unit | Forty-third Embodiment | Forty-fourth Embodiment | Forty-fifth Embodiment | Forty-sixth Embodiment | Forty-seventh Embodiment | Forty-eighth Embodiment |
|---|---|---|---|---|---|---|---|---|
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 320 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |
| Application status (Thickness accuracy) | | — | Good | Good | Good | Good | Good | Good |
| Material cost | | — | A | B | B | B | A | B |
| Volume content of solvent in mixed material | | (%) | 80 | 80 | 80 | 80 | 80 | 80 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference)

Forty-ninth Embodiment

A rectangular chip resistor according to a forty-ninth embodiment of the invention will now be described.

The rectangular chip resistor according to the forty-ninth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the forty-ninth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like nickel powder coated with gold (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described forty-ninth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 9 below.

Fiftieth Embodiment

A rectangular chip resistor according to a fiftieth embodiment of the invention will now be described.

The rectangular chip resistor according to the fiftieth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fiftieth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like nickel powder coated with platinum (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fiftieth embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 9 below.

Fifty-first Embodiment

A rectangular chip resistor according to a fifty-first embodiment of the invention will now be described.

The rectangular chip resistor according to the fifty-first embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-first embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like nickel powder coated with solder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifty-first embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 9 below.

Fifty-second Embodiment

A rectangular chip resistor according to a fifty-second embodiment of the invention will now be described.

The rectangular chip resistor according to the fifty-second embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-second embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 1 μm; aspect ratio between a thickness and a particle diameter of 10) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 80 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifty-second embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 9 below.

Fifty-third Embodiment

A rectangular chip resistor according to a fifty-third embodiment of the invention will now be described.

The rectangular chip resistor according to the fifty-third embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-third embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 50 μm; aspect ratio between a thickness and a particle diameter of 5) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 76 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifty-third embodiment of the invention, since the silane based coupling agent is added to the mixed material in 1 volume %, adhesion between the substrate and the mixed material is improved compared to those according to the twelfth embodiment and the thirteenth embodiment of the invention, enabling the strength of the electrode to improve to 320 N. The other characteristics are represented in Table 9 below.

Fifty-fourth Embodiment

A rectangular chip resistor according to a fifty-fourth embodiment of the invention will now be described.

The rectangular chip resistor according to the fifty-fourth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-fourth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:13:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (1/s); and the resulting mixed material (solvent content of 76 volume %) is kneaded by a three roll mill. The mixing ratio (mass ratio) between the conductive particles and the epoxy resin contained in the above mixed material is 83:17. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifty-fourth embodiment of the invention, since no whisker-like inorganic filler coated with a conductive film is contained in the mixed material, the strength of the electrode becomes 200 N, namely, the electrode strength is lowered. The other characteristics are represented in the following Table 9.

TABLE 9

| | | Unit | Forty-ninth Embodiment | Fiftieth Embodiment | Fifty-first Embodiment | Fifty-second Embodiment | Fifty-third Embodiment | Fifty-fourth Embodiment |
|---|---|---|---|---|---|---|---|---|
| Mixing ratio (volume ratio) | Carbon powder | (%) | 7 | 7 | 7 | 7 | 7 | 7 |
| | Whisker-like inorganic filler | (%) | 5 | 5 | 5 | 5 | 5 | — |
| | Flake-like conductive powder | (%) | 8 | 8 | 8 | 8 | 8 | 13 |
| | Epoxy resin containing liquid | (%) | 80 | 80 | 80 | 80 | 80 | 80 |
| Molecular weight of epoxy resin | | — | 50000 | 50000 | 50000 | 50000 | 50000 | 50000 |
| Boiling point of solvent | | (° C.) | 247 | 247 | 247 | 247 | 247 | 247 |
| Solvent content of epoxy resin containing liquid | | (%) | 66 | 66 | 66 | 66 | 66 | 66 |
| Surface area of carbon powder per 1 g | | $m^2$ | 2000 | 2000 | 2000 | 2000 | 2000 | 2000 |
| Whisker-like inorganic filler | Material | — | Potassium titanate | Potassium titanate | Potassium titanate | Potassium titanate | Potassium titanate | — |
| | Average fiber diameter | (μm) | 0.5 | 0.5 | 0.5 | 0.5 | 0.5 | — |
| | Average fiber length | (μm) | 30 | 30 | 30 | 30 | 30 | — |
| | Aspect ratio | — | 60 | 60 | 60 | 60 | 60 | — |
| | Coated conductive material | — | Silver | Silver | Silver | Silver | Silver | — |
| Flake-like conductive powder | Material | — | Gold coated nickel | Platinum coated nickel | Solder coated nickel | Silver | Silver | Silver |
| | Average particle diameter | (μm) | 5 | 5 | 5 | 1 | 50 | 5 |
| | Aspect ratio | — | 100 | 100 | 100 | 10 | 5 | 100 |
| Viscosity at 0.006 (1/s) | | (Pa · s) | 2000 | 2000 | 2000 | 2000 | 2000 | 2000 |
| Coupling agent | | (%) | 1 | 1 | 1 | 1 | 1 | 1 |
| Weight reduction | | (%) | 0.07 | 0.07 | 0.06 | 0.05 | 0.02 | 0.07 |
| Solder splash | | (number) | 0 | 0 | 0 | 0 | 0 | 0 |
| Plating | Plating quality | — | Good | Good | Good | Good | Good | Good |
| | Adhesiveness | — | Good | Good | Good | Good | Good | Good |
| Electrode strength | | (N) | 320 | 320 | 320 | 320 | 320 | 320 |
| Edge film thickness | | — | Good | Good | Good | Good | Good | Good |
| Flow of mixed material on substrate | | — | Good | Good | Good | Good | Good | Good |
| Viscosity change during operation | | — | No | No | No | No | No | No |

TABLE 9-continued

| | Unit | Forty-ninth Embodiment | Fiftieth Embodiment | Fifty-first Embodiment | Fifty-second Embodiment | Fifty-third Embodiment | Fifty-fourth Embodiment |
|---|---|---|---|---|---|---|---|
| Application status (Thickness accuracy) | — | Good | Good | Good | Good | Good | Good |
| Material cost | — | B | B | A | B | B | B |
| Volume content of solvent in mixed material | (%) | 80 | 80 | 80 | 80 | 76 | 76 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of of the cost in Comparative Example 1 as reference), C (equal to or more than 110% of the cost in Comparative Example 1 as reference)

Fifty-fifth Embodiment

A rectangular chip resistor according to a fifty-fifth embodiment of the invention will now be described.

The rectangular chip resistor according to the fifty-fifth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-fifth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:13:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 76 volume %) is kneaded by a three roll mill. The mixing ratio (mass ratio) between the conductive particles and the epoxy resin contained in the above mixed material is 77:23. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifty-fifth embodiment of the invention, since no flake-like conductive powder is contained in the mixed material, the amount of the conductive powder exposed on the surface of the end face electrode is small. This causes lowering of the plating adhesiveness. The other characteristics are represented in Table 10 below.

Fifty-sixth Embodiment

A rectangular chip resistor according to a fifty-sixth embodiment of the invention will now be described.

The rectangular chip resistor according to the fifty-sixth embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-sixth embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a conductive powder comprising a spherical shaped silver powder (average particle diameter of 5 μm; aspect ratio between a thickness and a particle diameter of 1), and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 7:5:8:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 76 volume %) is kneaded by a three roll mill. The mixing ratio (mass ratio) between the conductive particles and the epoxy resin contained in the above mixed material is 81:19. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that of the first embodiment of the invention.

In the above-described fifty-sixth embodiment of the invention, since a spherical silver conductive powder is used instead of a flake-like conductive powder, the resistance value is high. Thus, the plating thickness becomes thinner and the plating adhesiveness becomes weaker. The other characteristics are represented in Table 10 below.

Fifty-seventh Embodiment

A rectangular chip resistor according to a fifty-seventh embodiment of the invention will now be described.

The rectangular chip resistor according to the fifty-seventh embodiment of the invention has a configuration similar to the rectangular chip resistor according to the first embodiment of the invention as illustrated in FIGS. 1 and 2, except for the process of mixing and producing the end face electrode paste used for the end face electrode layers 15.

The production process of the rectangular chip resistor according to the fifty-seventh embodiment of the invention will now be described.

The process before securing the reed-shaped substrate by using a holding jig with a concavo-convex surface so as to make the end face electrode-forming surface flat is similar to that in the first embodiment of the invention.

In other words, after the reed-shaped substrate is secured by using the holding jig with an uneven surface so as to make the end face electrode-forming surface flat, the end face electrode layers are formed so as to cover at least portions of the upper surface electrode layers 12 in the following manner. An end face electrode paste is prepared in such a way that: a carbon powder having a surface area of 2,000 $m^2/g$, a whisker-like potassium titanate coated with silver (average fiber diameter of 0.5 μm; average fiber length of 30 μm; aspect ratio of 60) as the whisker-like inorganic filler, a flake-like silver powder (average particle diameter of 5 μm; aspect ratio between a thickness and a particle diameter of 100) as the flake-like conductive powder, and an epoxy resin-containing solution containing an epoxy resin having a molecular weight of 50,000 (solvent of a diethylene glycol monobutyl ether acetate having a boiling point of about 247° C.; solvent content of 66 volume %) are mixed at a volume ratio of 1:8:11:80; a silane based coupling agent and a suitable amount of diethylene glycol monobutyl ether acetate are added thereto so as to obtain 1 volume % of the coupling agent and a viscosity of 2,000 Pa·s at a shear rate of 0.006 (l/s); and the resulting mixed material (solvent content of 76 volume %) is kneaded by a three roll mill. The mixing ratio (mass ratio) between the conductive particles and the epoxy resin contained in the above mixed material is 85:15. Then, a stainless steel roller is preliminary provided thereon with the end face electrode paste having a uniform film thickness of about 50 μm. Subsequently, rotation of the stainless steel roller and movement of the holding jig with a concavo-convex surface bring the end face electrode paste on the stainless steel roller into contact with the end face electrode-forming surface of the reed-shaped substrate, thereby applying the mixed material onto the substrate end faces. Thereafter, the application status is confirmed by using an image recognition apparatus. The substrate, in which it has been confirmed that the end face electrode paste is applied throughout the end face electrode-forming surface of the reed-shaped substrate without application deficiency, is subjected to a heating process by means of a belt-type continuous far-infrared curing furnace by a temperature profile of a peak time of 30 minutes at 160° C. and an IN-OUT time of 40 minutes. According to the above-described process, the end face electrode layers 15 having a thickness of end face sections of about 5 to 10 μm are formed.

The last electroplating process is similar to that in the first embodiment of the invention.

In the above-described fifty-seventh embodiment of the invention, since the amount of carbon powder is small, the amount of solvent wetting the surface of the carbon powder is decreased. Thus, exudation of the resin component or the solvent component within the mixed material onto the substrate, which may occur while the mixed material is applied and cured, cannot be suppressed. Accordingly, flow of those components onto the substrate tends to increase. The other characteristics are represented in the following Table 10.

TABLE 10

| | | Unit | Fifty-fifth Embodiment | Fifty-sixth Embodiment | Fifty-seventh Embodiment | First Comparative Example |
|---|---|---|---|---|---|---|
| Mixing ratio (volume ratio) | Carbon powder | (%) | 7 | 7 | 1 | 14 |
| | Whisker-like inorganic filler | (%) | 13 | 5 | 8 | 5 |
| | Flake-like conductive powder | (%) | — | *8 | 11 | 6 |
| | Epoxy resin containing liquid | (%) | 80 | 80 | 80 | 75 |

TABLE 10-continued

| | | Unit | Fifty-fifth Embodiment | Fifty-sixth Embodiment | Fifty-seventh Embodiment | First Comparative Example |
|---|---|---|---|---|---|---|
| Molecular weight of epoxy resin | | — | 50000 | 50000 | 50000 | ** |
| Boiling point of solvent | | (° C.) | 247 | 247 | 247 | 194 |
| Solvent content of epoxy resin containing liquid | | (%) | 66 | 66 | 66 | 100 |
| Surface area of carbon powder per 1 g | | $m^2$ | 2000 | 2000 | 2000 | 800 |
| Whisker-like inorganic filler | Material | — | Potassium titanate | Potassium titanate | Potassium titanate | Potassium titanate |
| | Average fiber diameter | (μm) | 0.5 | 0.5 | 0.5 | 0.5 |
| | Average fiber length | (μm) | 30 | 30 | 30 | 30 |
| | Aspect ratio | — | 60 | 60 | 60 | 60 |
| | Coated conductive material | — | Silver | Silver | Silver | Silver |
| Flake-like conductive powder | Material | — | — | *Silver | Silver | Silver |
| | Average particle diameter | (μm) | — | 5 | 5 | 5 |
| | Aspect ratio | — | — | 1 | 100 | 100 |
| Viscosity at 0.006 (1/s) | | (Pa · s) | 2000 | 2000 | 2000 | 800 |
| Coupling agent | | (%) | 1 | 1 | 1 | 0 |
| Weight reduction | | (%) | 0.07 | 0.07 | 0.07 | 0.30 |
| Solder splash | | (number) | 0 | 0 | 0 | 12 |
| Plating | Plating quality | — | Good | Thin | Good | Thin |
| | Adhesiveness | — | Weak | Weak | Good | Weak |
| Electrode strength | | (N) | 380 | 320 | 380 | 230 |
| Edge film thickness | | — | Good | Good | Good | Thin |
| Flow of mixed material on substrate | | — | Good | Good | Large | Large |
| Viscosity change during operation | | — | No | No | No | Yes |
| Application status (Thickness accuracy) | | — | Good | Good | Good | Variation large |
| Material cost | | — | B | B | C | B |
| Volume content of solvent in mixed material | | (%) | 76 | 76 | 76 | 65 |

Solder splash: the number of occurrences among the number of N = 1,000

Plating quality: good (a film thickness of almost 100% under the condition of standard plating of 7 μm thickness), thin (a film thickness of approximately 70% under the condition of standard plating of 7 μm thickness)

Plating adhesiveness: good (there is no peeling found among 10 in tape peeling), weak (there is one or more peeling found among 10 in tape peeling)

Electrode strength: there is no problem if it is equal to or more than 200 N (tensile strength of 5 × 5 mm pattern)

Edge film thickness: good (equal to or more than 2 μm), thin (less than 2 μm)

Flow of mixed material on substrate: good (less than 100% with regard to standard flow amount of 100 μm), large (equal to or more than 100% with regard to standard flow amount of 100 μm)

Application status (thickness accuracy): good (less than ±5 μm), large (equal to or more than ±5 μm)

Material cost: A (equal to or less than 90% of the cost in Comparative Example 1 as reference), B (almost 100% of the cost in Comparative Example 1 as reference), C (equal to or more than 110% of the cost in Comparative Example 1 as reference.

*spherical silver conductive powder

** epoxy-modified phenol resin

As seen from Tables 1 through 10, the weight reduction rate of the end face electrode layer when heated to a temperature of 200° C. is 0.1% by mass or less, which is one of the objects of the present invention, and the solder splashing failure is zero among n=1,000 in each of the first through fifty-seventh embodiments of the invention. It is also seen that the extremely high electrode strength between 200 N and 320 N can be obtained because of the addition of the whisker-like inorganic filler coated with the conductive material.

As a Comparative Example 1, a rectangular chip resistor was produced using an epoxy-modified phenol resin instead of the epoxy resin in the first embodiment of the invention. In this Comparative Example 1, as seen from Table 10, the weight reduction rate of the end face electrode layer when heated to a temperature of 200° C. is 0.3% by mass and the solder splashing failure occurred in twelve among n=1,000.

In the above-described first through fifty-seventh embodiments, the rectangular chip resistors were exemplified as the chip-shaped electronic component, which are, however, not to be interpreted as restrictive. The effects similar to those in the above-described first through fifty-seventh embodiments will be achieved even in the case where the present invention is applied to a chip-shaped electronic component having an end face electrode other than those described above.

Also, even in the case where a spherical conductive particle is further added to the embodiments of the present invention in order to enhance conductivity, the effects similar to those in the first through the fifty-seventh embodiments of the invention can be obtained.

As having been described above, an aspect of the present invention is directed to a chip-shaped electronic component comprising a substrate and an end face electrode layer provided on an end face of the substrate, in which the end face electrode layer contains a mixed material including, as a conductive particle, a carbon powder, a whisker-like inorganic filler coated with a conductive film, and a flake-like conductive powder, and an epoxy resin having a molecular weight between 1,000 and 80,000.

With the above-described constitution, since the epoxy resin is used as one of the compounds for the end face electrode layer, weight reduction of the end face electrode layer can be suppressed below 0.1% by mass when the chip-shaped electronic component is heated to a temperature of 200° C. As a result, in a solder melting process when the chip-shaped electronic component is mounted onto a mounting substrate, the drawbacks such as perforation in the nickel-plated layer and the solder- or tin-plated layer, and solder splashing can be decreased. Since the epoxy resin has a molecular weight between 1,000 and 80,000, the epoxy resin is excellent in coatability of the substrate edge portion of the chip-shaped electronic component upon formation thereof. Accordingly, the drawbacks such as end face electrode disconnection at the substrate edge portion hardly occur. Therefore, a process of exchanging parts becomes unnecessary, resulting in an enhancement of productivity. Also, since the whisker-like inorganic filler coated with the conductive film is contained in the mixed material, fracture toughness of the end face electrode layer can be improved, enabling to increase the strength of the end face electrode layer. Further, since the flake-like conductive powder is contained in the mixed material, conductivity is also improved. Since there is large exposure of metal on the surface of the end face electrode layer due to the addition of the flake-like conductive powder, when the nickel-plated layer is formed by an electroplating method after the end face electrode layer is formed, the nickel-plated layer can be formed in good adhesiveness with the end face electrode layer. A stable and uniform film can also be formed.

The above whisker-like inorganic filler is exemplified by at least one selected from, but not limited to, the group consisting of potassium titanate, silica, wollastonite, sepiolite, zinc oxide, calcium carbonate, titanic oxide, barium sulfate, aluminum hydroxide, aluminum oxide, magnesium hydroxide, xonotlite, aluminum borate, magnesium sulfate, calcium silicate, silicon nitride, graphite, and silicon carbide. Examples of such a whisker-like inorganic filler include Dentool BK400 manufactured by Otsuka Chemical Co., Ltd. (potassium titanate); Arborex Y manufactured by Shikoku Chemicals Corporation (aluminum borate); MOS-HIGE manufactured by Ube Material Industries, Ltd. (magnesium sulfate); WHISCAL manufactured by MARUO CALCIUM CO., LTD. (calcium carbonate); and wollastonite KH-30 manufactured by Kawatetu Industries Co., Ltd.

Specifically, it is preferable for the whisker-like inorganic filler to contain potassium titanate. With such constitution, since the mixed material contains potassium titanate as the whisker-like inorganic filler, fracture toughness of the mixed material can be improved. Accordingly, the strength of the end face electrode layer can be improved.

The conductive film for coating the whisker-like inorganic filler is exemplified by at least one selected from, but not limited to, the group consisting of silver, nickel, gold, tin, copper, platinum, and solder.

It is preferable that the conductive film for coating the whisker-like inorganic filler contains silver. With such constitution, since the conductivity of the mixed material is improved by containing the whisker-like inorganic filler coated with silver, a stable and uniform nickel-plated layer can be formed when the nickel-plated layer is formed by an electroplating method after the end face electrode layer is formed.

It is preferable that the whisker-like inorganic filler has, but is not limited to, an average fiber diameter between 0.1 μm and 2 μm and an aspect ratio (average fiber length/average fiber diameter) between 10 and 100. The above-described average fiber diameter and the average fiber length are values obtainable through SEM observation.

It is preferable that the epoxy resin in a formulation of an epoxy resin-containing solution is mixed with the conductive particles. Examples of the above epoxy resin-containing solution include, but are not limited to, the Epicoat 1000 series manufactured by Japan Epoxy Resins Co., Ltd.; the EPICLON 9000 series manufactured by Dainippon Ink and Chemicals, Incorporated, and others. The molecular weight of the epoxy resin is the value (polystyrene calibration) measured by gel permeation chromatography of a solution prepared by solving the epoxy resin in tetrahydrofuran at a concentration of 0.1% by mass and passing the same through a membrane filter of 0.5 μm.

A preferable solvent content of the epoxy resin-containing solution is equal to or more than 60 volume %. With such constitution, since the epoxy resin-containing solution has a solvent content equal to or more than 60 volume %, the volume of the electrode obtainable in the case where the mixed material containing the conductive particle and the epoxy resin is applied onto the end face of the substrate and cured will become smaller. Accordingly, shapes of the chip-shaped electronic components upon application of the mixed material vary less, which contributes to an improvement in dimensional accuracy of the chip-shaped electronic components. The upper limit of the solvent content is not specifically limited; however, a preferable range of the solvent content is equal to or less than 80 volume %.

The carbon powder having a large surface area is preferable. Examples of the carbon powder include, but are not limited to, ROYAL SPECTRA manufactured by Columbian Carbon, Japan; EC600JD manufactured by Ketjen Black International Co.; #3950 manufactured by Mitsubishi Chemical Corporation; Black Pearl 2000 manufactured by Cabot Corporation; and others.

It is preferable that the carbon powder has a surface area equal to or more than 1,000 $m^2/g$. With such constitution, even with more amount of solvent to be added to the mixed material containing the conductive particle and the epoxy resin, the solvent can be sufficiently adsorbed onto a surface of the carbon powder. Accordingly, the resin component or the solvent component contained within the mixed material will be suppressed from exudation onto the substrate which occurs upon the application and curing of the mixed material. It is preferable, but not limited, for the upper limit of the surface area of the carbon powder to be equal to or less than 2,000 $m^2$. The surface area of the carbon powder is the value obtained in such a way that a sample of the carbon powder is measured by a BET method (Brunauer-Emmett-Teller method) provided that nitrogen is used for an adsorbate and the deaerating temperature is 200° C.

In the case where the mixed material is prepared by mixing the conductive particle and the epoxy resin-containing solution, it is preferable to adjust the relative amount of each component to be mixed. In particular, it is preferable that the mixing ratio (volume ratio) of the conductive particle with the epoxy resin-containing solution is between 10:90 and 30:70. With such constitution, the surface area resistance value of the end face electrode layer can be lowered. Accordingly, in the case where the nickel-plated layer is formed by an electroplating method after the end face electrode layers are formed, the nickel-plated layer which is stable and has a uniform film can be formed. Also, the electrode strength of the end face electrode layer can be made stronger. Here, it is preferable that the mixing ratio (mass ratio) of the conductive particle with the epoxy resin is between 51:49 and 85:15.

It is preferable to adjust the relative amount of each component forming the conductive particle. Especially, it is preferable that the mixing ratio (volume ratio) of the carbon powder with a combination of the whisker-like inorganic filler and the flake-like conductive powder is between 10:90 and 50:50. With such constitution, the surface area resistance value of the end face electrode layer can be lowered. Accordingly, in the case where the nickel-plated layer is formed by an electroplating method after the end face electrode layer is formed, the nickel-plated layer which is stable and has a uniform film can be formed. Also, the electrode strength of the end face electrode layer can be made stronger. Here, it is preferable that the mixing ratio (volume ratio) of the whisker-like inorganic filler with the flake-like conductive powder is between 25:75 and 50:50.

It is preferable that the mixed material further contains a coupling agent. With such constitution, the adhesiveness between the substrate and the end face electrode layer can be improved. Therefore, the electrode strength of the end face electrode layer can be made stronger.

Examples of the coupling agent include, but are not limited to, a silane based coupling agent such as γ-glycidoxypropyltrimethoxysilane, γ-glycidoxypropylmethyldiethoxysilane, γ-glycidoxypropyltriethoxysilane, and the like. They can be used whether taken alone or in combination. The most preferable among these is γ-glycidoxypropyltrimethoxysilane. It is preferable, but not limited, for the coupling agent to have a volume ratio, relative to the summed amount of the conductive particle and the epoxy resin, between 99.9:0.1 and 90:10 (the summed amount:the coupling agent).

When the mixed material containing the solvent is applied to the end faces of the substrate and cured in order to form the end face electrode layers, it is preferable that the mixed material containing the solvent has a viscosity equal to or more than 800 Pa·s at a shear rate of 0.006 (1/s). With such constitution, the mixed material immediately after application and before curing can be prevented from flowing onto the substrate. Therefore, dimensional accuracy of the end face electrode layers can be improved. The preferable upper limit of the viscosity is, but not limited to, equal to or less than 2,000 Pa·s. The above viscosity is a value measured under the conditions of using a low shear-controlling viscometer, in four degree cone, at a temperature of 25° C.

An example of the flake-like conductive powder is at least one selected from, but not limited to, a group consisting of the flake-like silver powder, the flake-like copper powder, the flake-like nickel powder, and the flake-like tin powder. Examples of the flake-like conductive powder include Silver Flake #4M manufactured by Degussa AG (silver powder); XF301 manufactured by FUKUDA METAL FOIL & POWDER CO., LTD. (silver powder); TC-25A manufactured by TOKURIKI-HONTEN (silver powder); HCA-1 manufactured by Inco Limited (nickel powder); MA-CF manufactured by MITSUI MINING & SMELTING CO., LTD. (copper powder); and others.

It is especially preferable that the mixed material contains the flake-like silver powder as the flake-like conductive powder. With such constitution, since the mixed material contains the flake-like silver powder as the flake-like conductive powder, the conductivity thereof is improved. Also, since a large area of metal is exposed on a surface of the end face electrode layer, a nickel-plated layer can be formed in good adhesiveness with the end face electrode layer in the case where the nickel-plated layer is formed by an electroplating method after the end face electrode layer is formed. Also, a stable and uniform film can be formed.

The flake-like conductive powder may be coated with the conductive film. An example of the conductive film is at least one selected from, but not limited to, the group of silver film, nickel film, gold film, tin film, copper film, platinum film, and solder film.

It is preferable that the flake-like conductive powder has an average particle diameter between 1 μm and 50 μm. With such constitution, since the flake-like conductive powder with an average particle diameter between 1 μm and 50 μm is used, the conductivity can be improved. Also, since a large area of metal is exposed on the surface of the end face electrode layer, a nickel-plated layer can be formed in good adhesiveness with the end face electrode layer in the case where the nickel-plated layer is formed by an electroplating method after the end face electrode layer is formed. A stable and uniform film can be formed.

It is preferable that the flake-like conductive powder has an aspect ratio between a thickness and a particle diameter being 5 or more. With such constitution, since the flake-like conductive powder with an aspect ratio between a thickness and a particle diameter being 5 or more is used, the conductivity thereof can be improved. Also, since metal is exposed in a large area of the surface of the end face electrode layer, a nickel-plated layer can be formed in good adhesiveness with the end face electrode layer in the case where the nickel-plated layer is formed by an electroplating method after the end face electrode layer is formed. A stable and uniform film can be formed.

The average particle diameter of the flake-like conductive powder is a value of D50 in a particle size distribution obtained by using a laser diffractometry and scattering method. The aspect ratio between a thickness and a particle diameter is the ratio between an average thickness and an average particle diameter of the above D50 measured by SEM observation (average particle diameter/average thickness).

Since the chip-shaped electronic component according to the present invention uses the epoxy resin as the resin for forming the end face electrode layer, weight reduction of the end face electrode layer in 0.1% by mass or more can be suppressed when heated to a temperature of 200° C. As a result, in the solder melting step during a process of mounting the chip-shaped electronic component on the mounting substrate, drawbacks such as perforation in the nickel-plated layer, the solder-plated layer or the tin-plated layer, and solder splashing can be decreased. As such drawbacks decrease, a process for exchanging parts becomes unnecessary, enabling to improve productivity. Also, since the whisker-like inorganic filler coated with the conductive film is added to the mixed material, fracture toughness of the end face electrode layer is increased, enabling to improve the strength of the end face electrode layer. Also, since the flake-like conductive powder is added to the mixed material, the nickel-plated layer can be formed in good adhesiveness with the end face electrode layer in the case where the nickel-plated layer is formed by an electroplating method after the end face electrode layer is formed. A stable and uniform film can also be formed.

The invention claimed is:

1. A chip-shaped electronic component, comprising:

a substrate; and an end face electrode layer provided on an end face of the substrate;

wherein the end face electrode layer contains a mixed material including conductive particles and an epoxy resin having a weight-average molecular weight between 1,000 and 80,000, the conductive particles comprising a carbon powder, an inorganic filler consisting of only a whisker-like inorganic filler coated with a conductive film, and a flake-like conductive powder having an aspect ratio between a thickness and a particle diameter being equal to or more than 5.

2. The chip-shaped electronic component according to claim 1, wherein the mixed material contains, as the whisker-like inorganic filler, at least one selected from the group consisting of potassium titanate, silica, wollastonite, sepiolite, zinc oxide, calcium carbonate, titanic oxide, barium sulfate, aluminum hydroxide, aluminum oxide, magnesium hydroxide, xonotlite, aluminum borate, magnesium sulfate, calcium silicate, silicon nitride, graphite, and silicon carbide.

3. The chip-shaped electronic component according to claim 1, wherein the conductive film for coating the whisker-like inorganic filler contains at least one selected from the group consisting of silver, nickel, gold, tin, copper, platinum, and solder.

4. The chip-shaped electronic component according to claim 1, wherein the epoxy resin is mixed with the conductive particle by using an epoxy resin-containing solution having a solvent content equal to or more than 60 volume %.

5. The chip-shaped electronic component according to claim 1, wherein the carbon powder has a surface area equal to or more than 1,000 $m^2/g$.

6. The chip-shaped electronic component according to claim 4, wherein a mixing ratio (volume ratio) of the conductive particle with the epoxy resin-containing solution (the particle:the solution) is between 10:90 and 30:70.

7. The chip-shaped electronic component according to claim 1, wherein a mixing ratio (volume ratio) of the carbon powder with a combination of the whisker-like inorganic filler and the flake-like conductive powder (the carbon powder:the combination) is between 10:90 and 50:50.

8. The chip-shaped electronic component according to claim 1, wherein the end face electrode layer is formed in such a way that the mixed material is applied to the end face of the substrate and thus applied mixed material is cured; and wherein the mixed material has a viscosity equal to or more than 800 Pa·s at a shear rate of 0.006 (l/s).

9. The chip-shaped electronic component according to claim 1, wherein the mixed material contains, as the flake-like conductive powder, at least one selected from the group consisting of a flake-like silver powder, a flake-like copper powder, a flake-like nickel powder, and a flake-like tin powder.

10. The chip-shaped electronic component according to claim 1, wherein the flake-like conductive powder is coated with a conductive film.

11. The chip-shaped electronic component according to claim 10, wherein the conductive film for coating the flake-like conductive powder contains at least one selected from the group consisting of silver, nickel, gold, tin, copper, platinum, and solder.

12. The chip-shaped electronic component according to claim 1, wherein the flake-like conductive powder has an average particle diameter between 1 μm and 50 μm.

13. A chip-shaped electronic component, comprising:

a substrate; and an end face electrode layer provided on an end face of the substrate;

wherein the end face electrode layer contains a mixed material including conductive particles, an epoxy resin having a weight-average molecular weight between 1,000 and 80,000, and a coupling agent, the conductive particles comprising a carbon powder, an inorganic filler consisting of only a whisker-like inorganic filler coated with a conductive film, and a flake-like conductive powder having an aspect ratio between a thickness and a particle diameter being equal to or more than 5.

14. The chip-shaped electronic component according to claim 13, wherein the mixed material contains, as the whisker-like inorganic filler, at least one selected from the group consisting of potassium titanate, silica, wollastonite, sepiolite, zinc oxide, calcium carbonate, titanic oxide, barium sulfate, aluminum hydroxide, aluminum oxide, magnesium hydroxide, xonotlite, aluminum borate, magnesium sulfate, silicate calcium, silicon nitride, graphite, and silicon carbide.

15. The chip-shaped electronic component according to claim 13, wherein the conductive film for coating the whisker-like inorganic filler contains at least one selected from the group consisting of silver, nickel, gold, tin, copper, platinum, and solder.

16. The chip-shaped electronic component according to claim 13, wherein the epoxy resin is mixed with the conductive particle by using an epoxy resin-containing solution having a solvent content equal to or more than 60 volume %.

17. The chip-shaped electronic component according to claim 13, wherein the carbon powder has a surface area equal to or more than 1,000 $m^2/g$.

18. The chip-shaped electronic component according to claim 16, wherein a mixing ratio (volume ratio) of the conductive particle with the epoxy resin-containing solution (the particle:the solution) is between 10:90 and 30:70.

19. The chip-shaped electronic component according to claim 13, wherein a mixing ratio (volume ratio) of the carbon powder with a combination of the whisker-like inorganic filler and the flake-like conductive powder (the carbon powder:the combination) is between 10:90 and 50:50.

20. The chip-shaped electronic component according to claim 13, wherein the end face electrode layer is formed in such a way that the mixed material is applied to the end face of the substrate and thus applied mixed material is cured; and wherein the mixed material has a viscosity equal to or more than 800 Pa·s at a shear rate of 0.006 (l/s).

21. The chip-shaped electronic component according to claim 13, wherein the mixed material contains, as the flake-like conductive powder, at least one selected from the group consisting of a flake-like silver powder, a flake-like copper powder, a flake-like nickel powder, and a flake-like tin powder.

22. The chip-shaped electronic component according to claim 13, wherein the flake-like conductive powder is coated with a conductive film.

23. The chip-shaped electronic component according to claim 22, wherein the conductive film for coating the flake-like conductive powder contains at least one selected from the group consisting of silver, nickel, gold, tin, copper, platinum, and solder.

24. The chip-shaped electronic component according to claim 13, wherein the flake-like conductive powder has an average particle diameter of 1 μm to 50 μm.

* * * * *